US006575696B1

(12) United States Patent
Lyons et al.

(10) Patent No.: US 6,575,696 B1
(45) Date of Patent: Jun. 10, 2003

(54) METHOD OF SOUND ATTENUATION IN CENTRIFUGAL BLOWERS

(75) Inventors: Leslie A. Lyons, Cassville, MO (US); David A. Fisher, Cassville, MO (US)

(73) Assignee: Fasco Industries, Inc., Cassville, MO (US)

( * ) Notice: Subject to any disclaimer, the term of this patent is extended or adjusted under 35 U.S.C. 154(b) by 0 days.

(21) Appl. No.: 09/951,277

(22) Filed: Sep. 11, 2001

Related U.S. Application Data

(60) Provisional application No. 60/234,129, filed on Sep. 21, 2000.

(51) Int. Cl.[7] ..... F04D 29/44
(52) U.S. Cl. ..... 415/119; 415/204; 415/206
(58) Field of Search ..... 415/119, 203, 415/204, 206

(56) References Cited

U.S. PATENT DOCUMENTS 3,093,299 A * 6/1963 Hammann et al. ..... 415/90
3,415,443 A * 12/1968 Glucksman ..... 415/53.1
3,824,028 A * 7/1974 Zenkner et al. ..... 415/58.6
6,200,093 B1 * 3/2001 Lee et al. ..... 415/206

FOREIGN PATENT DOCUMENTS

EP 573895 A1 * 12/1993
JP 354 009 006 A * 1/1979

* cited by examiner

*Primary Examiner*—Ninh H. Nguyen
(74) *Attorney, Agent, or Firm*—Andrus, Sceales, Starke & Sawall, LLP

(57) ABSTRACT

A centrifugal blower housing that includes sound attenuating features to decrease the noise generated by the pressure fluctuations due to blade pass. The blower housing includes at least one sound attenuating cavity positioned along the exhaust section integrally formed as part of the blower housing. The sound cavity creates a sound dampening zone near the outlet of the blower housing to attenuate the sound generated by the rotating impeller. The blower housing further includes an angled cut off portion positioned near the intersection of the exhaust section and the scroll section of the blower housing. The angled cut off portion creates an uneven surface that disrupts the pressure fluctuation created as the impeller blades pass over the cut off edge surface. The angled cut off portion extends into the interior of the exhaust section and defines an irregular surface along at least a portion of the exhaust section.

14 Claims, 7 Drawing Sheets

METHOD OF SOUND ATTENUATION IN CENTRIFUGAL BLOWERS

CROSS REFERENCE TO RELATED APPLICATION

The present invention is based on and claims priority to U.S. Provisional Patent Application Ser. No. 60/234,129 filed on Sep. 21, 2000.

BACKGROUND OF THE INVENTION

The present invention relates generally to centrifugal blowers. More specifically, the present invention is directed to a method and housing configuration for attenuating the sound caused by blade pass in centrifugal blowers.

The need to move large quantities of air is ever present in heating, ventilating and air conditioning appliances. To meet these air handling requirements, a variety of fans and blowers are most often employed. Of the various types of blowers, centrifugal blowers are the most widely used because they can effectively move large or small quantities of air over a wide range of pressures. Unfortunately, one of the drawbacks to these types of blowers is that the blowers generate unwanted sound (noise;) that can be a distraction or annoyance, or more seriously, can impose health and safety risks.

The noise from centrifugal blowers is a primary superposition of discrete frequency noise (pure tones) at the impeller or blade pass frequency. The origin of these discrete tones stems from two sources. First, each time a blade passes a point in space, a pressure fluctuation is created at the blade passing frequency due to the displacement of air. Second, as the blades pass the cut off point in the scroll section of the housing, abrupt pressure changes or pulses also occur at the blade passing frequency.

The predominant method of attenuating the sound generated by centrifugal blowers has been to place a system of filters and/or silencers at the inlet or outlet of the blower. Although these types of silencing devices can reduce the sound emanating from the blower, the use of a silencer or filter results in several drawbacks. First, silencers and/or filters add to the overall cost of the air handling system since silencers and filters are additional parts that need to be properly selected and engineered into the system to be effective and need to be maintained/replaced when necessary. Second, silencing devices take up unnecessary space near the blower housing. Finally, silencing devices can affect the overall performance of the system because the silencing devices can become clogged with dust particles and other forms of debris.

Thus, due to the widespread use of blowers many of today's air handling applications, a need exists for a more efficient and reliable method of attenuating unwanted sound (noise) created by blade pass in an operating blower.

SUMMARY OF THE INVENTION

The present invention relates to an apparatus and method for attenuating noise caused by blade pass in centrifugal blowers. The centrifugal blower of the present invention includes a blower housing that encloses a rotating impeller for creating a flow of air out of an outlet opening formed by the blower housing. An electric motor is mounted onto the blower housing such that the motor shaft rotates the impeller within the blower housing.

As the impeller rotates within the blower housing, the blades of the impeller pass by a cut off formed along the interior of the blower housing between the scroll section of the blower housing and an integrally formed exhaust section.

In accordance with the invention, an angled cut off portion is formed along the intersection between the tubular exhaust section and the scroll section in order to disrupt the pressure fluctuations created by the orientation of the cut off and the impeller blades. Specifically, the angled cut off portion is formed by a protruding molded area having an irregular outer surface that varies the angle between the impeller blades and the cut off edge.

In addition to the angled cut off portion, the blower housing of the present invention includes at least one sound cavity that extends outward from the outer wall of the exhaust section. The sound cavity creates an open space that attenuates the sound created by the rotating impeller within the blower housing. In the preferred embodiment of the invention, a single sound cavity is positioned between the outlet opening formed in the exhaust section and the scroll section of the blower housing. However, it is contemplated that a pair of sound cavities could be utilized on opposite sides of the exhaust section to further dampen the noise created by the rotating impeller.

An important aspect of the invention is that the combination of the sound cavities and the angled cut off provide sound attenuation without effecting the blower performance. A further advantage of the present invention is to provide an improved blower housing and design a method that attenuates noise associated with impeller blade pass without requiring additional components.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
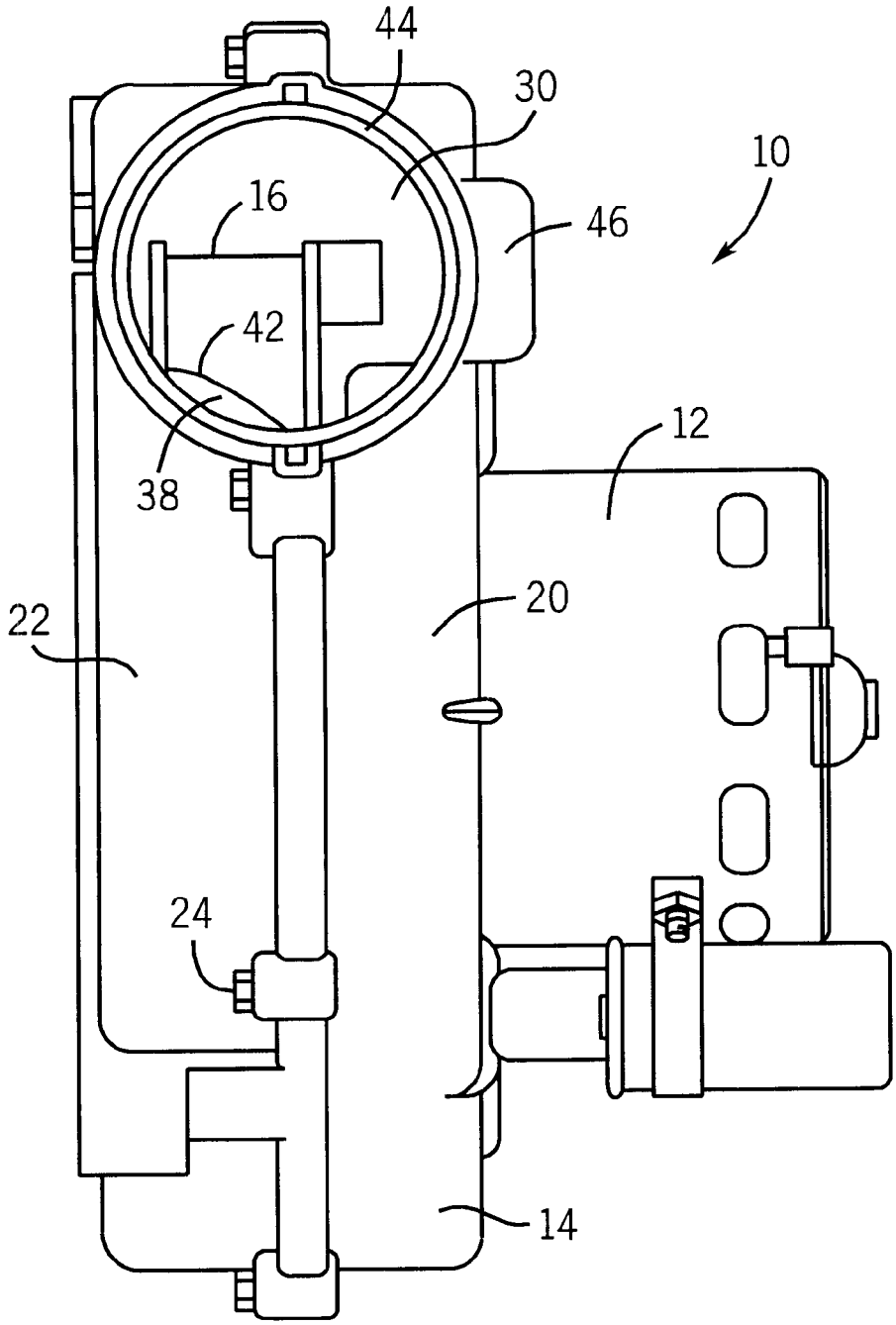
FIG. 1 is a front view of the centrifugal blower design of the present invention including sound attenuation features.

Referring first to FIG. 1, thereshown is a centrifugal blower 10 constructed in accordance with the present invention. The blower 10 generally includes an electric motor 12 mounted to a blower housing 14 that encloses a rotating impeller 16. The impeller 16 is of conventional shape and includes a plurality of individual impeller blades. The impeller 16 is connected to a motor shaft extending from the electric motor 12 into the enclosed blower housing 14 through a shaft opening 18 formed in the center of the blower housing 14.

Figure 2:
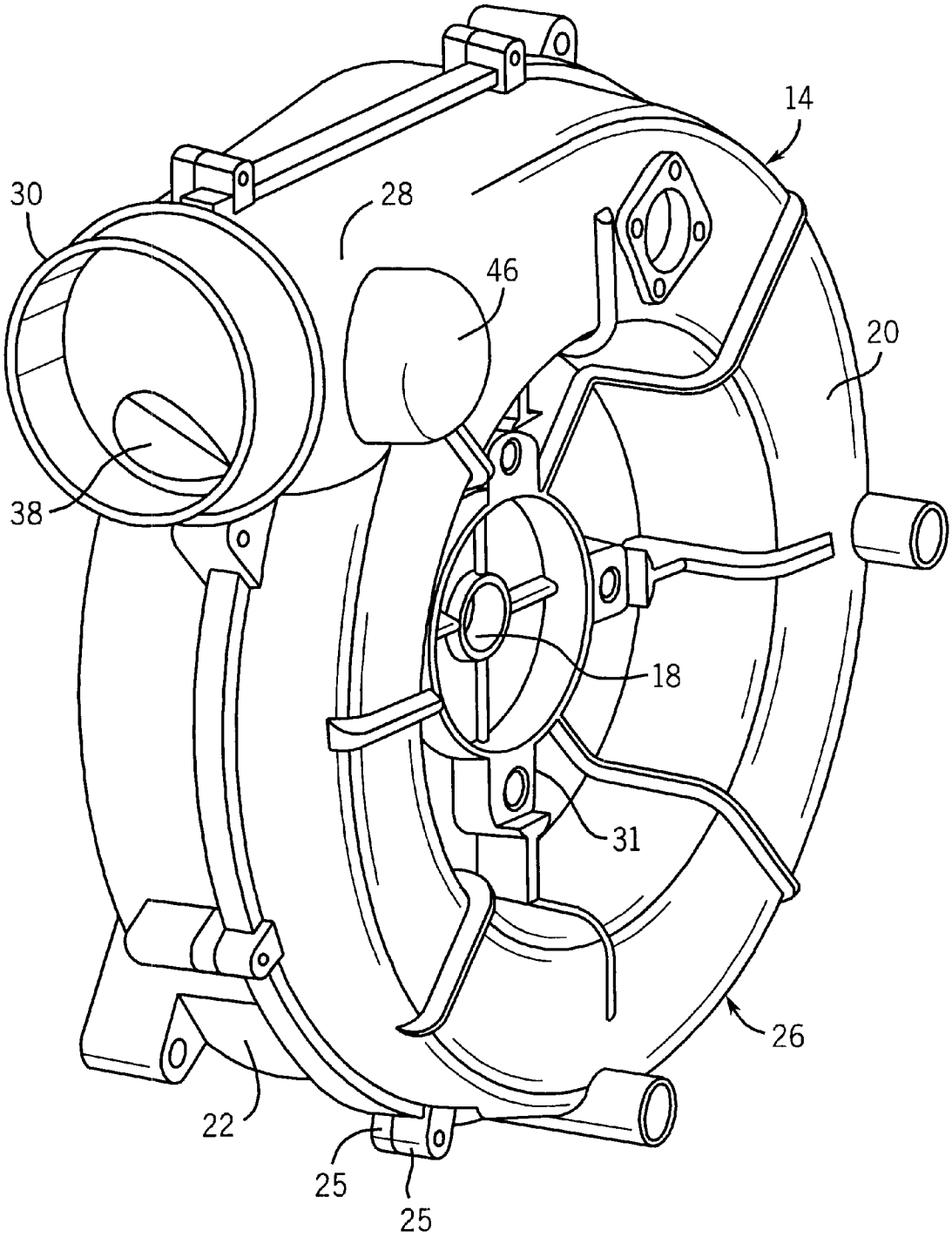
FIG. 2 is a perspective view of the blower housing constructed in accordance with the present invention.

As can be seen in FIGS. 1 and 2, the blower housing 14 is formed from a motor shell 20 and an inlet shell 22 that are joined to each other along their outer circumference by a series of connectors 24 that pass through mating connector tabs 25. In the preferred embodiment to the invention, the both the motor shell 20 and the inlet shell 22 are formed from a molded thermal plastic material.

When the motor shell 20 and the inlet shell 22 are joined to each other, the shells define a circular scroll section 26 and an exhaust section 28 that terminates with an outlet opening 30. During operation of the centrifugal blower 10 of the present invention, the impeller 16 rotates within the blower housing 14 and draws a flow of air through openings formed in the inlet shell 22. The air entering through the inlet shell 22 is directed radially outward by the scroll section 26 and exists the blower housing 14 through the outlet opening 30.

Figure 3:
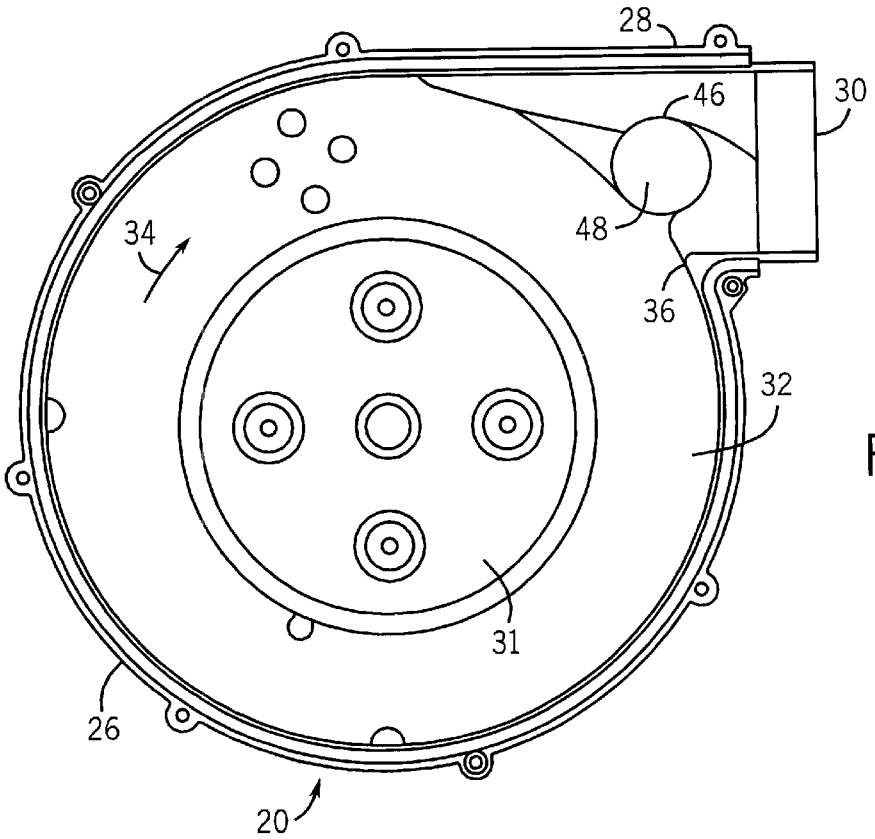
FIG. 3 is a side view of the inner surface of one-half of the molded blower housing illustrated in FIG. 2.

Referring now to FIGS. 2 and 3, the motor shell 20 includes an indented mounting surface 31 that is set off from the outer surface of the motor shell 20 to define a flow channel 32. The flow channel 32 guides the air flow created by the rotating impeller, illustrated by arrow 34, toward the outlet opening 30. Half of the circular outlet opening 30 is formed as part of the tubular exhaust section 28.

As illustrated in FIG. 3, the transition from the circular flow channel 32 to the tubular exhaust section 28 is defined by a cut off edge 36. In the motor shell 20, as shown in FIG. 3, the cut off edge 36 is generally parallel to the impeller blades as the impeller blades rotate toward the cut off edge 36. In a prior art blower, the cut off edge 36 formed by the motor shell 20 and the cut off edge formed by the inlet shell 22 were both parallel to the impeller as the impeller approached the cut off. This parallel relationship between the impeller and the cut off edge created a pressure fluctuation at the blade passing frequency, which resulted in undesirable noise.

Figure 4:
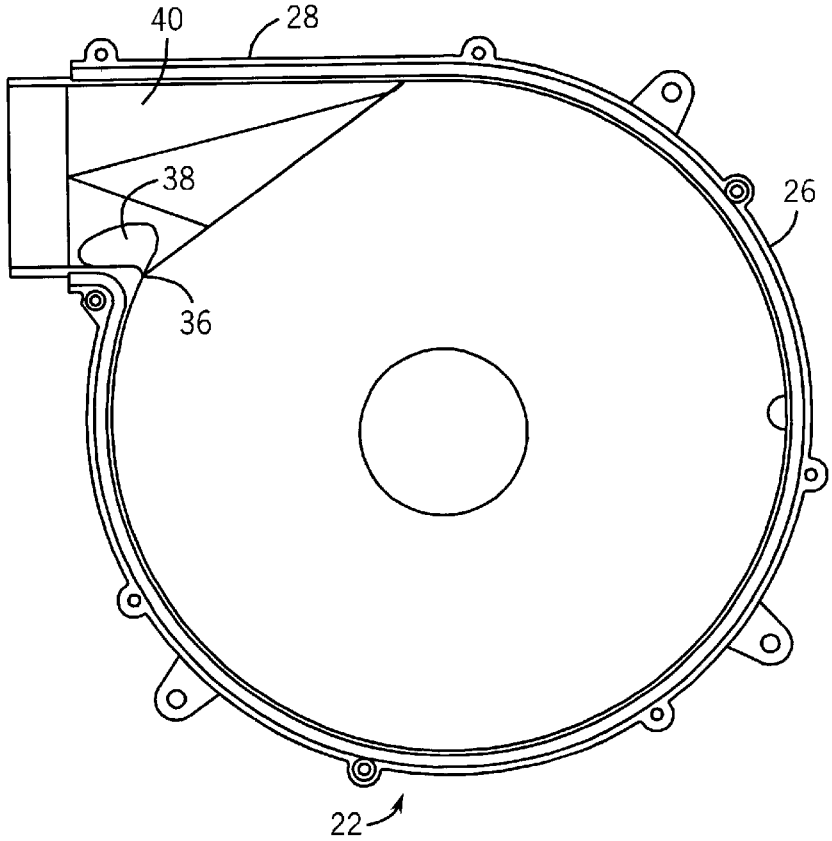
FIG. 4 is a side view of the inner surface of the opposite half of the molded blower housing illustrated in FIG. 2.

Referring now to FIG. 4, the inlet shell 22 of the present invention also defines the cutoff edge 36 between the scroll section 26 and the exhaust section 28. The present invention includes an angled cut off portion 38 that is positioned along the curved inner wall 40 of the outlet tube 28. As can be seen in FIG. 1, the angled cut off portion 38 defines a curved outer surface 42 that extends radially inward from the outer circumferential edge 44 of the outlet opening 30. Thus, as the impeller rotates within the blower housing 14, the impeller blades approach the angled cut off portion 38 at an angle, rather than the normal parallel relationship as described. The curved outer surface 42 of the angled cut off portion 38 thereby reduces the pressure fluctuations created by the impeller blade passing over the cut off edge 36. The reduction in the pressure fluctuation thereby reduces the amount of noise created by the rotating impeller 16 within the circumferential blower 10.

As shown in FIGS. 2 and 4, in the preferred embodiment of the invention the angled cut off portion 38 is molded integrally with the inlet shell 22 and can be formed of various shapes and sizes, depending upon the particular impeller configuration and the configuration of the blower housing.

Additionally, although the angled cut off portion 38 is illustrated as being included only on the inlet shell 22, it is contemplated by the inventor that a similar angled cut off portion 38 could be included on the interior surface of the motor shell 20 near the cut off edge 36. However, in accordance with the present invention, only a single angled cut off portion 38 is illustrated.

Referring now to FIGS. 1 and 2, the motor shell 20 of the blower housing 14 includes a sound cavity 46 that protrudes from the curved outer wall of the motor shell 20 that defines the exhaust section 28. The sound cavity 46 is positioned between the circular scroll section 26 of the blower housing 14 and the outlet opening 30 generally along the exhaust section 28.

Referring now to FIG. 3, the sound cavity 46 defines a hollow open interior 48 that extends away from the open interior defined by the flow channel 32 and the inner wall of the exhaust section 28. In operation, the sound cavity 46 acts as a sound cushion that minimizes the noise generated by air currents reverberating against the inner walls of the blower housing.

Although only a single sound cavity 46 is shown extending from the exterior surface of the motor shell 20, it is contemplated by the inventor that an identical sound cavity could be located on the opposite side of the exhaust section 28 and thus be formed in the inlet shell 22. The sound cavity formed in the inlet shell 22 would also act as a sound cushion to minimize the noise generated by air currents reverberating against the inner walls of the blower housing, Referring now to FIG. 5, thereshown is a sound signature of an existing prior art centrifugal blower. As illustrated in this Figure, in the blade pass frequency ranges of 668 to 674 HZ, as illustrated by reference numeral 50 and 1334 to 1346 HZ, as illustrated by reference numeral 52, the corresponding level of noise generated by the centrifugal blower are 53.268 and 55.502 decibels, respectfully.

Figure 6:
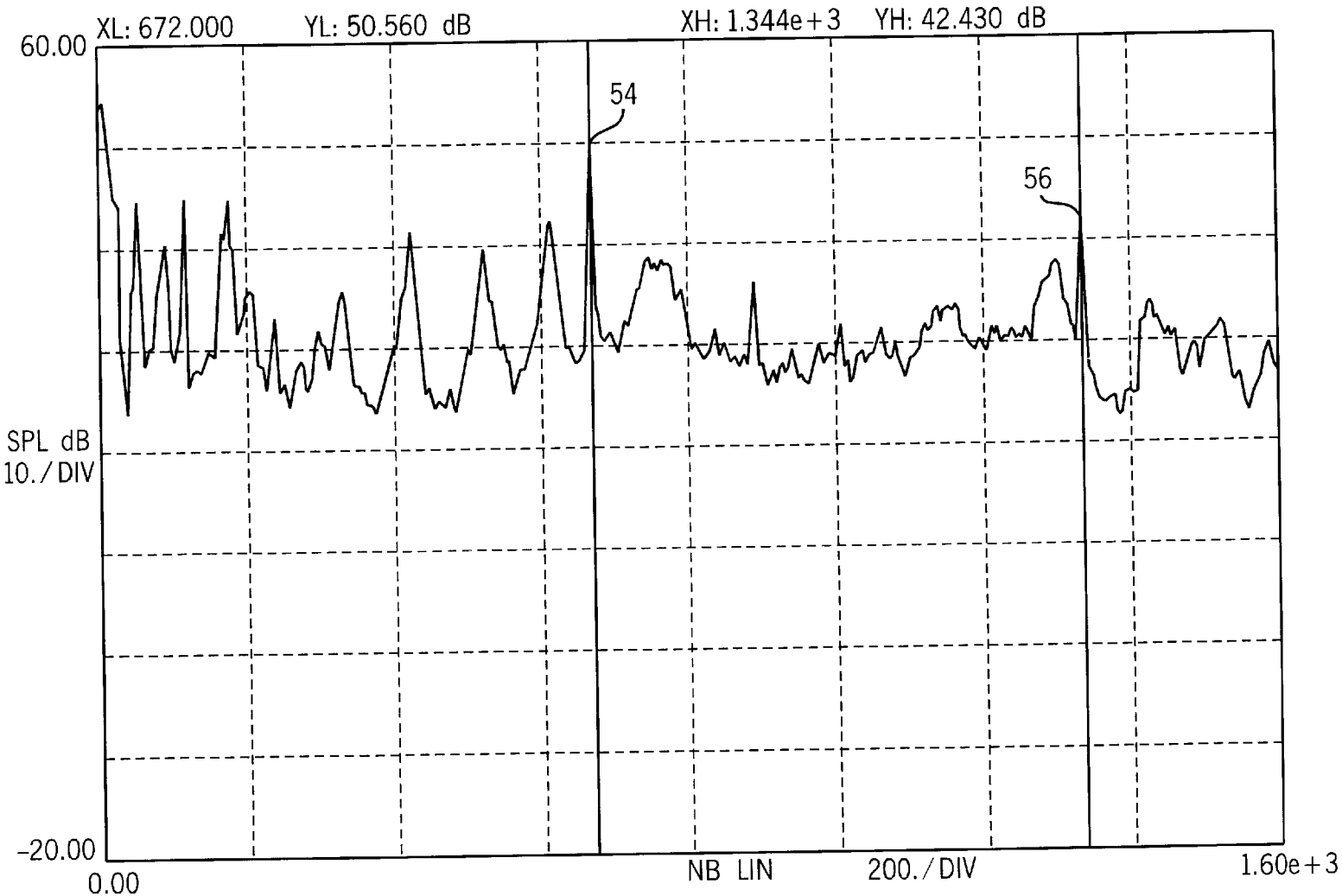
FIG. 6 is a sound signature of a blower housing including a sound cavity formed in the blower housing of the present invention.

Referring now to FIG. 6, thereshown is the sound signature from a blower housing including the sound cavity 46 added to the exterior surface of the tubular exhaust section. As illustrated in this figure, the decibel levels within the same blade pass frequency range are 50.56 and 42.43, as illustrated by reference numerals 54 and 56. Thus, it is clear that the noise generated by the centrifugal blower 10 when utilizing only the external sound cavity increases a significant amount as compared to a blower that does not include such cavities.

Figure 7:
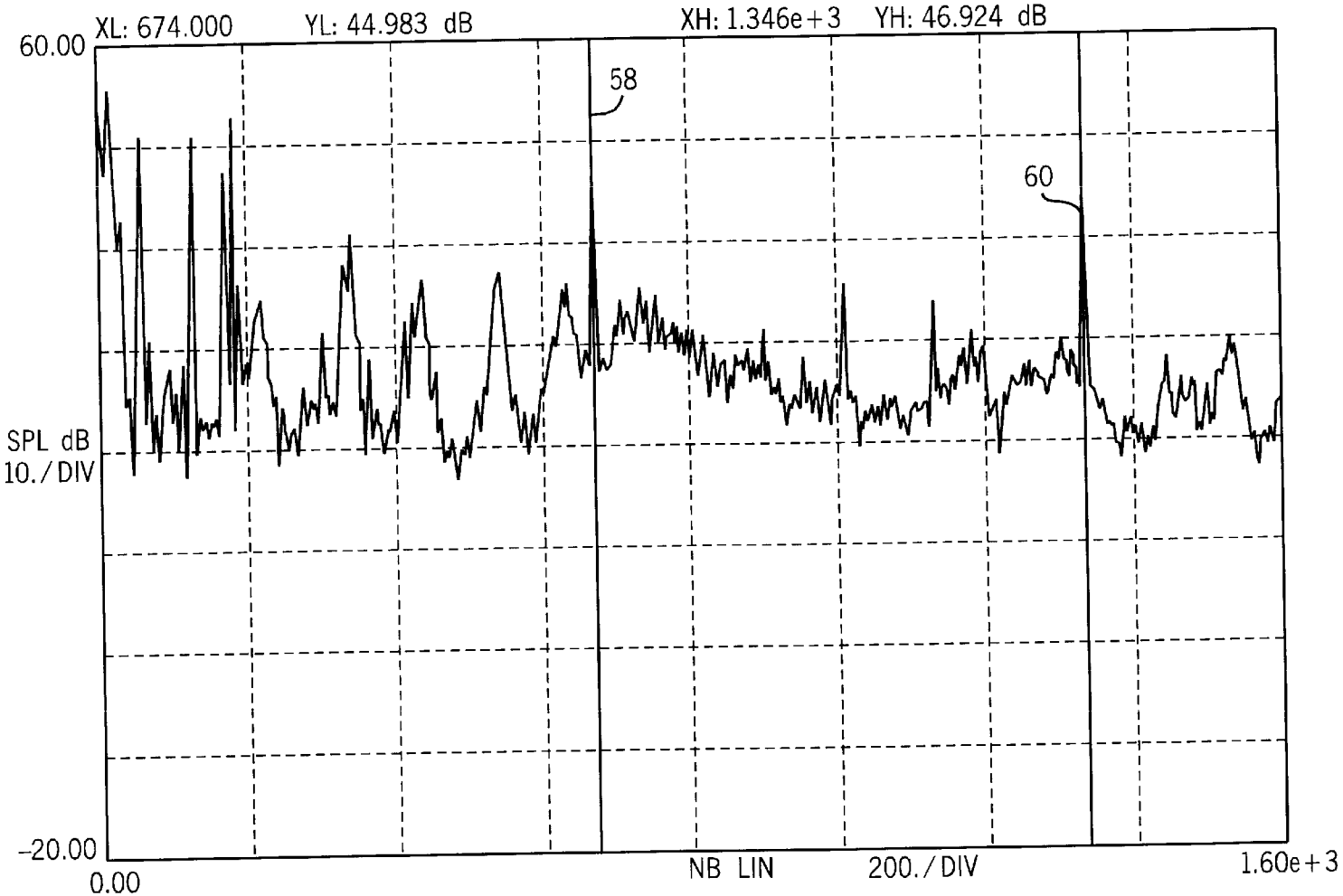
FIG. 7 is a sound signature of a blower housing including both the sound cavity and the modified cut off.

Referring now to FIG. 7, there shown is the sound output for a blower housing that includes both the sound cavity and the angled cut off surface formed near the outlet opening for the blower housing. In the blade pass frequency ranges being analyzed, the decibel levels dropped to 44.983 at the frequency range of 668 to 674 HZ, as illustrated by reference numeral 58, and 46.924 in the frequency range of 1334 to 1346 HZ, as illustrated by reference numeral 60.

Figure 5:
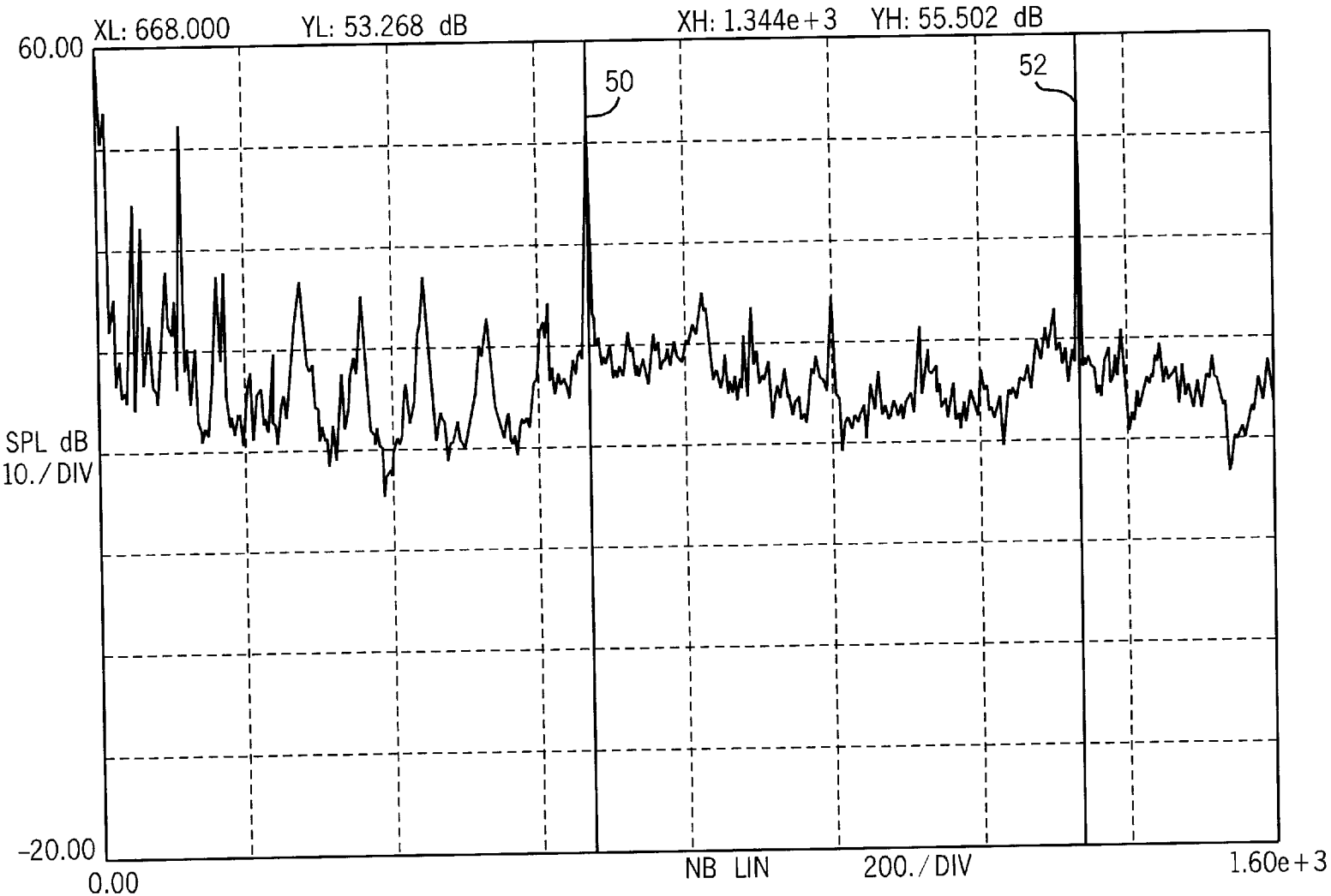
FIG. 5 is a sound signature for a prior art blower housing.

Based upon the data presented in FIGS. 6 and 7, as compared to the graph of FIG. 5, it is evident that with the addition of a sound cavity and/or a modified angled cut off portion, the noise generated by the blade pass in the centrifugal blower is significantly attenuated.

Figure 8:
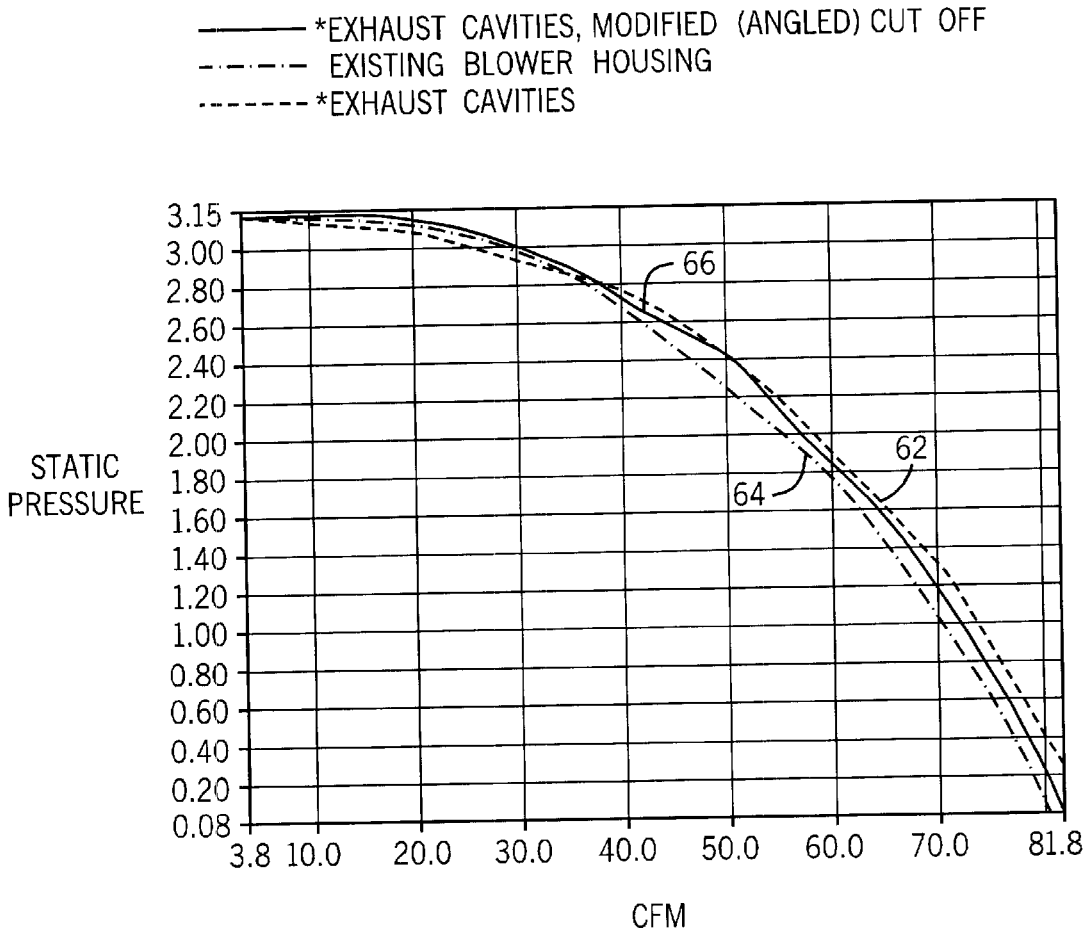
FIG. 8 is a graphic illustration of the flow output of the centrifugal blower including the sound cavity and the modified cut off.

Although the angled cut off portion and the sound cavity function well to reduce the noise level generated by the operating centrifugal blower, a concern is that the centrifugal blower generate a similar flow performance as compared to an existing blower housing. Referring now to FIG. 8, thereshown is a graph illustrating the output and pressure for three different configurations. Line 62 illustrates a pre-existing blower housing that does not include either the sound cavities or the angled cut off portion. Line 64 illustrates a blower housing including the sound cavity extending from the outer wall of the outlet tube. Finally, line 66 illustrates a blower housing including both the sound cavity and the angled cut off portion. As graphically depicted, only trivial differences appear in the performance among these three variations of the blower housing. Therefore, employing the sound cavity or the combination of the sound cavity with the angled cut off portion has little effect on the efficiency and performance of the centrifugal blower.

Although the present invention has been described as including a specific combination and location for both the angled cut off portion 38 and the sound cavity 46, it should be understood that the present invention can be modified and should not be limited to the particular construction enclosed herein. As an example, it is contemplated by the inventors that more than one sound cavity and more than one angled cut off portion can be utilized in the blower housing while operating within scope of the present invention.

Various alternatives and embodiments are contemplated as being within the scope of the following claims particularly pointing out and distinctly claiming the subject matter regarded as the invention.

We claim:

1. A centrifuigal blower, comprising:

a blower housing having a molded inlet shell and a molded motor shell configured for attachment to each other to define a scroll section and an exhaust section when the inlet shell is attached to the motor shell, wherein the scroll section is joined to the exhaust section along a cut off edge surface;

a rotating impeller positioned within the scroll section of the blower housing, the rotating impeller including a plurality of impeller blades that rotate past the cut off edge to direct a flow of air out of the exhaust section; and a sound cavity formed in one of the mating inlet shell and motor shell, the sound cavity being configured to extend from the exhaust section of the blower housing to attenuate the sound created by the rotation of the impeller blades past the cut off edge.

2. The centrifugal blower of claim 1 wherein the exhaust section extends tangentially from the scroll section of the blower housing.

3. The centrifugal blower of claim 2 wherein the exhaust section is defined by a tubular outer wall that defines an open exhaust passageway between the scroll section and an exhaust outlet opening.

4. The centrifugal blower of claim 3 wherein the sound cavity protrudes from the outer wall of the exhaust section and is open to the exhaust outlet passageway.

5. The centrifugal blower of claim 4 wherein the sound cavity is positioned along the exhaust section between the exhaust outlet opening and the cut off edge surface.

6. The centrifugal blower of claim 1 further comprising a pair of sound cavities, one of which is molded into each of the inlet shell and the motor shell, wherein each of the pair of sound cavities extends from the exhaust section when the inlet shell is attached to the motor shell.

7. A centrifugal blower, comprising:

a blower housing having a circular scroll section and an exhaust section defined by a tubular outer wall that defines an open exhaust passageway and a circular outlet opening, wherein the scroll section is joined to the exhaust section along a cut off edge surface;

a rotating impeller positioned within the scroll section of the blower housing, the rotating impeller including a plurality of impeller blades that rotate past the cut off edge to direct a flow of air out of the exhaust section, wherein the impeller blades are generally parallel to the cut off edge as the impeller blades approach the cut off edge surface; and at least one angled cut off portion positioned along a section of the cut off edge surface, wherein the angled cut off portion extends from the cut off edge to the tubular outer wall of the exhaust section such that the rotating impeller blades approach the angled cut off portion at an angle, wherein the cut off portion extends from the cut off edge toward the circular outlet opening and terminates prior to the circular outlet opening.

8. The centrifugal blower of claim 7 wherein the angled cut off portion is formed on one-half of the cut off edge surface.

9. A centrifugal blower, comprising a blower housing having a circular scroll section and an exhaust section defined by a tubular outer wall that defines an open exhaust passageway and a circular outlet opening, wherein the scroll section is joined to the exhaust section along a cut off edge surface;

a rotating impeller positioned within the scroll section of the blower housing, the rotating impeller including a plurality of impeller blades that rotate past the cut off edge surface to direct a flow of air out of the exhaust section, wherein the impeller blades are generally parallel to the cut off edge surface as the impeller blades rotate past the cut off edge surface;

a sound cavity extending from the exhaust section of the blower housing to attenuate the sound created by the passage by the impeller blades past the cut off edge surface; and an angled cut off portion positioned along a section of the cut off edge surface, wherein the angled cut off portion extends from the cut off edge surface to the tubular outer wall of the exhaust section such that the rotating impeller blades approach the angled cut off portion at an angle, wherein the cut off portion extends from the cut off edge toward the circular outlet opening and terminates prior to the circular outlet opening.

10. The centrifugal blower of claim 9 wherein the tubular exhaust section extends tangentially from the circular scroll section.

11. The centrifugal blower of claim 10 wherein the sound cavity protrudes from the outer wall of the exhaust section and is open to the exhaust outlet passageway.

12. A centrifugal blower of claim 9 wherein the centrifugal blower includes a pair of sound cavities extending from the exhaust section.

13. The centrifugal blower of claim 9 wherein the angled cut off portion is formed on one-half of the cut off edge surface.

14. A centrifugal blower, comprising:

a blower housing having a molded plastic inlet shell and a molded plastic motor shell configured for attachment to each other to define a scroll section and an exhaust section when the inlet shell is attached to the motor shell, the exhaust section being defined by a tubular outer wall that defines an open exhaust passageway and a circular outlet opening, wherein the scroll section is joined to the exhaust section along a cut off edge surface;

a rotating impeller positioned within the scroll section of the blower housing, the rotating impeller including a plurality of impeller blades that rotate past the cut off edge to direct a flow of air out of the exhaust section, wherein the impeller blades are generally parallel to the cut off edge as the impeller blades approach the cut off edge surface;

a sound cavity formed in one of the mating inlet shell and motor shell, the sound cavity being configured to extend from the exhaust section of the blower housing to attenuate the sound created by the rotation of the impeller blades past the cut off edge; and an angled cut off portion positioned along a section of the cut off edge surface, wherein the angled cut off portion extends from the cut off edge surface to the tubular outer wall of the exhaust section such that the rotating impeller blades approach the angled cut off portion at an angle;

wherein the cut off portion extends from the cut off edge toward the circular outlet opening and terminates prior to the circular outlet opening.

* * * * *